United States Patent [19]

Rautakorpi et al.

[11] Patent Number: 4,958,444

[45] Date of Patent: Sep. 25, 1990

[54] APPARATUS FOR DRYING A FIBRE WEB

[75] Inventors: Paavo Rautakorpi, Tampere; Jukka Lehtinen, Helsinki; Pekka Majaniemi, Pirkkala, all of Finland

[73] Assignee: Oy Tampella AB, Tampere, Finland

[21] Appl. No.: 348,858

[22] Filed: May 8, 1989

[30] Foreign Application Priority Data

May 18, 1988 [FI] Finland ..... 882337

[51] Int. Cl.[5] ..... F26B 19/00

[52] U.S. Cl. ..... 34/71; 34/9; 34/95

[58] Field of Search ..... 34/69, 71, 95, 9, 17, 34/18, 19; 68/5 D, 5 E

[56] References Cited

U.S. PATENT DOCUMENTS 4,112,586 9/1978 Lehtinen ..... 34/95 X 4,457,145 7/1984 Sando et al. ..... 68/5 E

*Primary Examiner*—Henry A. Bennet

*Assistant Examiner*—John Sollecito

*Attorney, Agent, or Firm*—Ladas & Parry

[57] ABSTRACT

An apparatus for drying a fibre web (4), wherein the web (4) is dired in at least two successive drying zones between a heated band (1*b*, 1*d*) and a cooled band (1*a*, 1*c*) moving substantially in parallel with and at equal speed as the web (4), the bands being endless and air-tight and having good thermal conductivity. In order to shorten the apparatus and to save energy, it comprises several drying zones positioned on top of each other in a direction transverse to the surface of the web (4), whereby the web (4) moves in opposite directions in drying zones positioned immediately on top of each other. Further, the endless band (1*b*, 1*c*) positioned between two drying zones positioned on top of each other forms one of the drying elements in both drying zones, whereby the same cooling or heating means (8, 9) positioned within the band (1*b*, 1*c*) between the rolls (2*b*, 3*b*; 2*c*, 3*c*) can cool or heat the web sections positioned within the length of both drying zones.

7 Claims, 2 Drawing Sheets

APPARATUS FOR DRYING A FIBRE WEB

Figure 1:
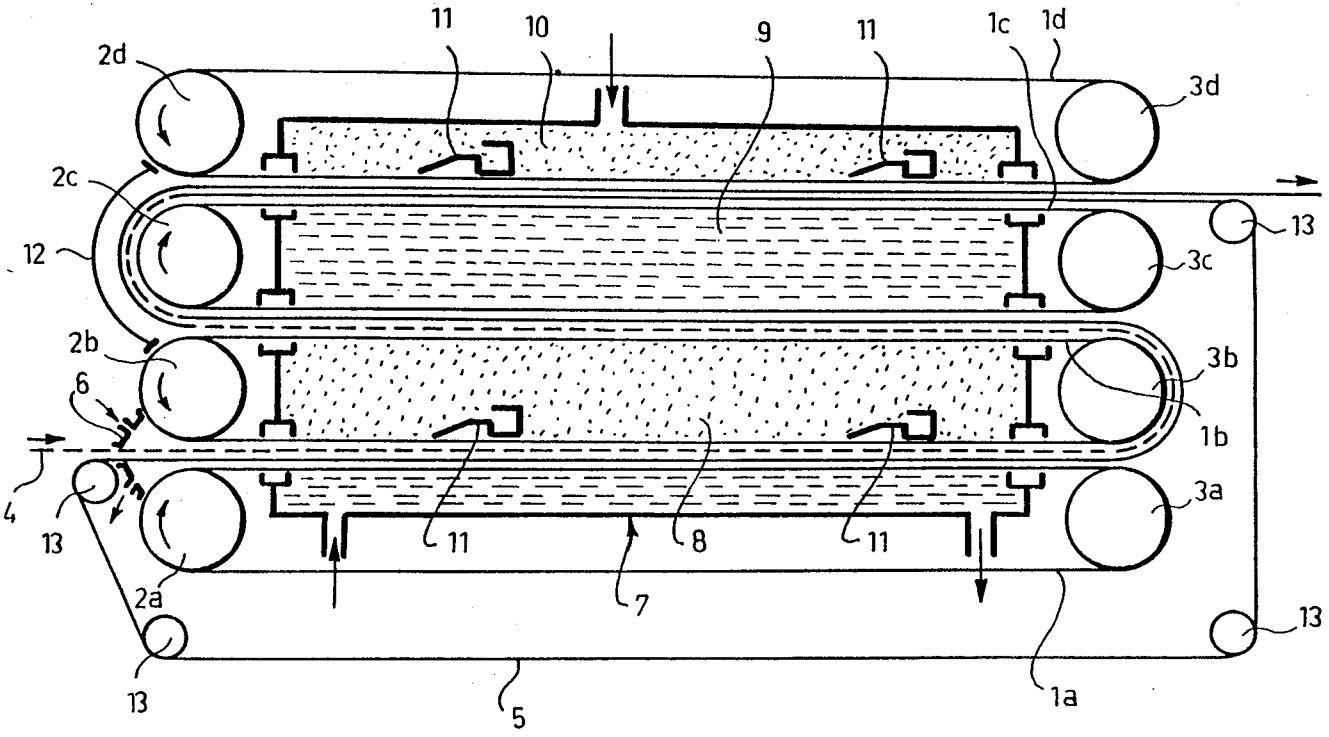

The invention relates to an apparatus for drying a fibre web, comprising at least one drying felt for receiving water from the web to be dried; means for removing water from the felt; means for removing air from the web and from the felt; and at least two drying zones positioned one after another in the direction of movement of the web, the web and the felt being passed on within the drying zones between two drying elements positioned against each other and moving in parallel with and at the same speed as said web and said felt in such a manner that the web makes contact with the surface of one drying element and the felt with the surface of the other drying element, each drying element comprising an endless, air-tight band with good thermal conductivity and means for moving the band in said manner; means for heating each band making contact with the web; and means for cooling each band making contact with the felt.

Such apparatuses are known from Finnish Patent Nos. 54514 and 63078, for instance. Both apparatuses disclosed in these citations comprise two separate drying zones, each provided with two superimposed, endless, air-tight bands with good thermal conductivity. A web together with a drying felt is led between the bands in such a manner that the web makes contact with the surface of one band and the felt with the surface of the other band. The surface in contact with the web is heated while the surface in contact with the felt is cooled.

In both citations, the drying zones are separate units comprising a band to be heated and a band to be cooled, each provided with turning rolls and stretch rolls for moving the bands in parallel with the web and the felt side by side therewith.

A drawback of the solutions disclosed in the citations is that several successive drying zones require plenty of room in the longitudinal direction and, as a consequence, plenty of floor area; in the worst case, they may be nearly as long as conventional drying sections Furthermore, the hot band cools while it is being returned, which involves waste of energy and considerable deterioration in the efficiency of the apparatus. Moreover, the empty space above the drying apparatus cannot be utilized in any way, and the steam dome which has to be constructed around the apparatus is large in dimensions and therefore expensive.

Still another drawback of the apparatuses known from the prior art is that thicker web portions possibly formed by fibre bundles cause the rolls around which the bands move to be exposed to abrupt shocklike strains since the spacing between the bands is designed for a substantially even web.

The object of the present invention is to provide a device which avoids the above-mentioned drawbacks, which is relatively short, and utilizes effectively the available height and is not sensitive to strains caused by fibre bundles with a thickness exceeding that of the web. According to the invention, this is achieved in such a manner that at least two drying zones are mounted on top of each other in a direction perpendicular to the surface of the web; and that at least one endless band is arranged to form one of the drying elements in two drying zones positioned immediately on top of each other, the direction of movement of the web in said two drying zones being opposite.

The basic idea of the invention is that several drying zones are mounted on top of each other in a direction transverse to the surface of the web, whereby the mechanical total length of the apparatus is very small. The basic idea of the invention further implies that one and the same endless band is used as a drying element on adjacent sides of two drying zones positioned on top of each other. Thereby the heated band in particular, instead of cooling when being returned to the inlet of the same drying zone, is now heated also on its way back so that it acts as a heated band in the following drying zone when it moves in the opposite direction. In other words, the web can be heated in a simple manner by means of the same heating means in two drying zones positioned one after another in the direction of movement of the web, which saves energy.

Figure 3:
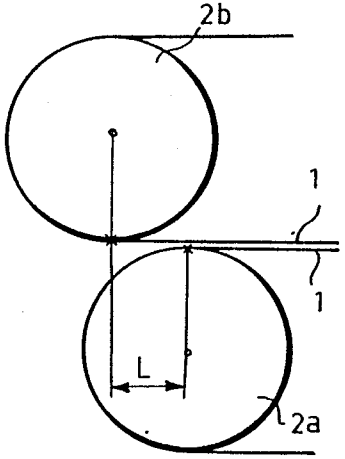
Figure 2:
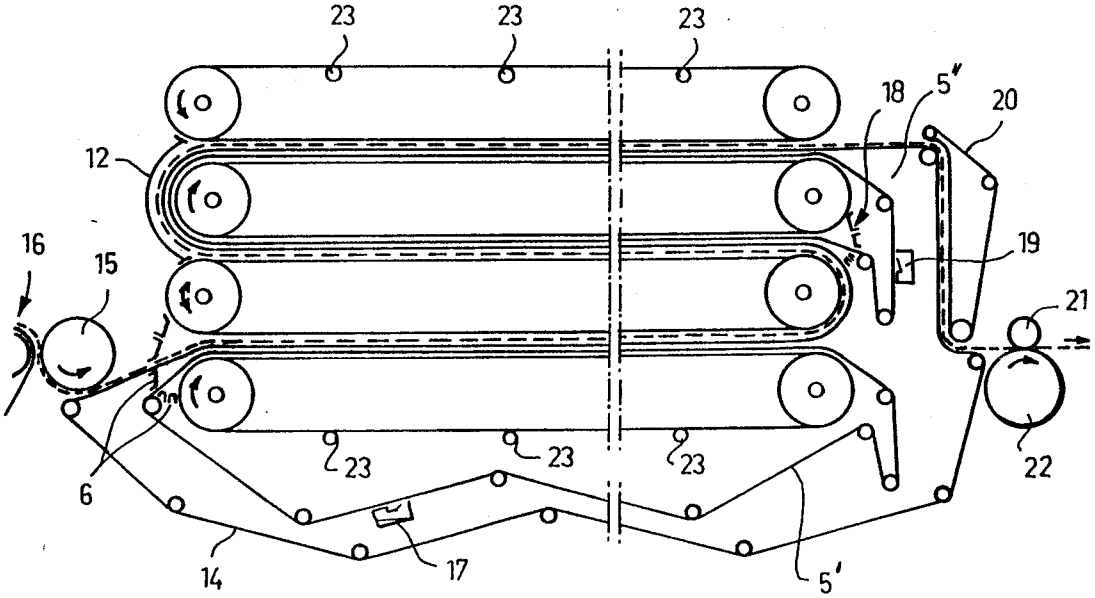

The invention will be described in more detail in the attached drawings, wherein FIG. 1 is a schematical sectional view of an apparatus according to the invention from the side;

FIG. 2 is a more detailed view of one practical realization of the apparatus of FIG. 1; and FIG. 3 illustrates in more detail the mounting of the turning rolls of the bands of the apparatus of FIG. 2 with respect to each other.

FIG. 1 shows an apparatus for drying a fibre web, comprising endless bands 1*a*–1*d* mounted on top of each other. Each band is arranged to move around interspaced rolls 2*a*–2*d* and 3*a*–3*d*, respectively, in such a manner that adjacent bands are substantially parallel with each other between the rolls and so spaced from each other that a web. 4 and a felt 5 can be led therebetween. The rolls 2*a*–2*d* and 3*a*–3*d*, respectively, are mounted substantially on top of each other, so that the bands 1*a*–1*d* are also positioned upon each other. The drying felt 5 passes between the bands 1*a* and 1*b*, 1*b* and 1*c*, and 1*c* and 1*d*, acting as a drying felt for each drying zone. At the inlet of the apparatus, that is, at the junction of the bands 1*a* and 1*b* adjacent to the rolls 2*a* and 2*b*, there are provided air removal means 6 comprising a dome provided with a slit for the web 4 and the felt 5. In the air removal means, air contained in the pores of the web 4 and the felt 5 is removed by filling the pores with hot saturated steam which is blown through the web 4 and the felt 5. A container 7 is provided within the band 1*a* between the rolls 2*a* and 3*a*. The container is sealed against the inner surface of the upper half of the band 1*a*. Cool or cold medium such as water is introduced into the container 7 through its one end for cooling the band 1*a* and removed from the other end. A container or space 8 sealed against the inner surface of the band 1*b* both at the bottom and at the top is provided between the rolls 2*b* and 3*b* of the band 1*b*. Through conduits not shown hot medium such as saturated steam is introduced into the container 8 for heating the band 1*b* at the top and at the bottom between the rolls 2*b* and 3*b*. Furthermore, a container or space 9 is provided between the rolls 2*c* and 3*c* of the band 1*c*, which space is sealed against the inner surface of the band 1*c* at the top and at the bottom between the rolls 2*c* and 3*c*. Cold medium such as water can be introduced into the container or space 9 through conduits not shown for cooling the band 1*c* between the rolls 2*c* and 3*c* at the top and at the bottom. Similarly, a container or space 10 sealed against the inner surface of the band at the bottom between the rolls is provided within the band 1*d* between the bands 2*d* and 3*d*. Hot medium such as saturated steam can be introduced into the container 10. Doctor blades 11 are provided against the lower inner surface of the bands 1*b* and 1*d* within the spaces 8 and 10. The doctor blades 11 gather the water condensed on the surface of the bands and pass it out of the space.

The web 4 to be dried is led together with the drying felt 5 into the first drying zone formed by the bands 1*a* and 1*b* so that the web 4 is positioned against the heated band 1*b* and the felt against the cooled band 1*a*. At the terminal end of the first drying zone, the web 4 and the felt 5 turn with the band 1*b* around its turning roll 3*b* so that the web is pressed into contact with the surface of the band 1*b*, while one surface of the felt is in contact with the web 4 and the other surface in contact with air. The web 4 and the felt 5 are further passed between the bands 1*b* and 1*c*. The band 1*b* is again heated and the band 1*c* is cooled so that the web 4 makes contact with the surface of the band 1*b* and the felt 5 makes contact with the surface of the band 1*c* while the web 4 and the felt 5 are also in contact with each other. After they have passed through the second drying zone formed by the bands 1*b* and 1*c*, they are further passed together with the band 1*c* around its turning roll 2*c* between the bands 1*c* and 1*d*. The web 4 now forms the outermost layer so that it is turned towards air, which would deteriorate the drying efficiency. Therefore a steam dome 12 is mounted outside the roll 2*c* between the rolls 2*b* and 2*d* so as to prevent air from entering the web 4. After the web 4 and the felt 5 have passed through the third drying zone formed by the bands 1*c* and 1*d*, the web 4 and the felt 5 are separated from each other, the web 4 being passed on to the following process stage and the felt 5 is led back to the inlet end of the drying apparatus by means of auxiliary rolls 13. Before being returned to the drying apparatus, the felt is dewatered by means of dewatering means known per se (not shown).

In FIG. 2, the same reference numerals as in FIG. 1 are used for corresponding parts. FIG. 2 shows schematically a practical realization of the apparatus in more detail than FIG. 1. As distinct from the apparatus shown in FIG. 1, it comprises a separate transport wire 14 which, as shown in the figure, moves through all the drying zones similarly as the felt 5. The web 4 is passed e.g. by means of a roll 15 from a press section 16 on to the wire 14 and further through the air removal means 6 to the inlet of the first drying zone similarly as the drying felt which is also passed through the air removal means 6. The first drying zone, within which most water is removed from the web 4, comprises a separate drying felt 5′ which moves around the band 1*a* and thus also around the rolls 2*a* and 3*a*. At the terminal end of the first drying zone, the felt 5′ is separated from the wire 14 and it is returned in a manner known per se by means of various auxiliary and stretch rolls from below the band 1*a* to the inlet of the first drying zone. During returning, water is removed from the felt 5′ by dewatering means 17. The wire 14 and the web 4 turn with the band 1*b* around the roll 3*b* while the wire 14 is on the outside, and they pass between the bands 1*b* and 1*c* into the second drying zone formed by them, whereby the web 4 is again positioned against the heated band 1*b*. At the junction of the bands 1*b* and 1*c* between the rolls 3*b* and 3*c*, there are provided air removal means 18 for a drying felt 5″. The air removal means comprise a closed and sealed chamber through which the felt 5″ passes before it enters the drying zone. In the chamber, hot saturated steam is applied through the felt 5″ so as to remove the water contained in the pores of the felt and to replace it with steam. The second felt 5″ is passed through the second air removal means 18 and further between the wire 14 and the cooled band 1*c* so that it makes contact with the surface of the band 1*c*. While the web 4 makes contact with the heated band 1*b* and the felt 5″ with the surface of the cooled band 1*c*, they move together with the wire 14 positioned therebetween through the second drying zone and out of it while the bands 1*b* and 1*c* turn apart from each other around the rolls 2*b* and 2*c*. At this stage, the felt 5″, the wire 14 and the web 4 turn with the band 1*c* around the roll 2*c*, being passed into the third drying zone between the bands 1*c* and 1*d*. In order to protect the web 4 and to prevent its pores from being filled with air, a steam dome 12 is provided outside the roll 2*c* between the bands 1*b* and 1*d*. The dome prevents air from entering the web.

Within the third drying zone, the felt 5″ again makes contact with the surface of the cooled band 1*c* while the web 4 is brought into contact with the surface of the heated band 1*d*, so that the web 4 and the felt 5″ as well as the wire 14 positioned therebetween move through the third drying zone while the web 4 makes contact with the heated surface and the felt 5″ with the cooled surface. At the terminal end of the third drying zone, the felt 5″ is separated apart from the wire 14, whereby it is passed by means of auxiliary and stretch rolls known per se downwards and through dewatering means 19 back to the second drying zone. The wire 14, instead, transports the web 4 onwards until it is transferred on to a subsequent wire 20 and further to the following process stage by means of the rolls 21 and 22, for instance. The wire 14 is further passed by means of auxiliary and stretch rolls known per se back to the inlet end of the drying apparatus and further to the inlet together with the web.

An advantage of the apparatus is that it is simple and compact and the bands 1*a*–1*d* need not be supported over the entire length of the dryer because the bands are kept substantially straight within each particular drying zone by pressurizing the media suitably with respect to each other. It is only those portions of the bands 1*a* and 1*d* which do not form part of the drying zones that have to be supported e.g. by means of separate support rolls 23 in order to keep them straight within these sections. Outside the drying zones, the felts and the wires are passed on by means of support, stretch and turning rolls known per se. The number and positions of the rolls are obvious to one skilled in the art and are chosen as required in each particular case.

As shown in FIG. 2, the rolls 2*a*–2*d* and 3*a*–3*d*, positioned on top of each other, respectively, are not in alignment with each other in the vertical direction; instead, adjacent rolls are positioned at a distance from each other in the longitudinal direction of the bands. This is described in more detail in FIG. 3, which shows the mutual position of the two rolls 2*a* and 2*b* positioned on top of each other. The axes of the rolls 2*a* and 2*b* shown in FIG. 3 are spaced apart in the direction of the drying zone formed by the bands 1*a* and 1*b* so that the point at which the band 1*b* is tangent to the roll 2*b*, that is, the point at which it leaves the roll, is positioned before the corresponding point between the band 1*a* and the roll 2*a*. The web 4, the wire 14 and the felt 5′ thereby make contact between the bands 1*a* and 1*b* in such a way that when they simultaneously make contact with both bands, there is a roll behind one of them only.

This structure is advantageous when for one reason or another there are fibre bundles or other such accumulations in the web which are thicker than the rest of the web. The band, in this particular case the band 1*b*, thereby yields away from the roll 2*a*, so that no such abrupt shock effects are created as with rolls positioned in alignment with each other. When this structure is applied in the rolls 2*a*–2*d* and 3*a*–3*d* of all bands, respectively, the same advantage is obtained at the beginning of each drying zone, which reduces the strains exerted on the apparatus.

The attached figures and the description describe, by means of example, one specific way of realizing the apparatus according to the invention. In the preferred embodiment, the apparatus comprises several drying zones positioned on top of each other and the web enters the first drying zone from one end of the apparatus and leaves the apparatus from the last drying zone at the opposite end. In this case, the number of the drying zones has to be uneven so that an even number of bands can be mounted to operate in two drying zones positioned immediately on top of each other. However, the apparatus may also comprise an even number of drying zones, whereby the web can be passed from the terminal end of the last drying zone into the following process stage using conventional solutions. Even though the apparatus described above is positioned in the horizontal direction so that the drying zones are substantially horizontal, it is also possible to mount the apparatus so that it is positioned in the vertical direction, whereby the web can be introduced through the lower or upper end and correspondingly, removed from the upper or lower end, depending on the number of the drying zones. In the solution described, a separate transport wire and two separate drying felts are used. The apparatus can also be realized by using one felt extending throughout the apparatus, whereby the felt can be dewatered, if necessary, between the drying zones. No transport wire is needed but the web can be transported on a felt. Further, it is possible to use several drying felts and transfer the web from one drying zone to another by means of a special pick-up wire.

We claim:

1. An apparatus for drying a fibre web (4), comprising at least one drying felt (5; 5', 5'') for receiving water from the web (4) to be dried; means (17, 19) for removing water from the felt (5; 5', 5''); means (6, 18) for removing air from the web (4) and from the felt (5; 5', 5''); and at least two drying zones positioned one after another in the direction of movement of the web (4), the web (4) and the felt (5; 5', 5'') being passed on within the drying zones between two drying elements positioned against each other and moving in parallel with and at the same speed as said web and said felt in such a manner that the web (4) makes contact with the surface of one drying element and the felt (5; 5', 5'') with the surface of the other drying element, each drying element comprising an endless, air-tight band (la-ld) with good thermal conductivity and means for moving the band (1*a*–d) in said manner; means (8, 10) for heating each band (1*b*, 1*d*) making contact with the web (4); and means for cooling each band (1*a*, –1*c*) making contact with the felt (5; 5', 5''), characterized in that at least two drying zones are mounted on top of each other in a direction perpendicular to the surface of the web (4); and that at least one endless band (1*b*, 1*c*) is arranged to form one of the drying elements in two drying zones positioned immediately on top of each other, the direction of movement of the web (4) in said two drying zones being opposite.

2. An apparatus according to claim 1, characterized in that the number of the drying zones positioned on top of each other is uneven and that the drying elements on adjacent sides of each pair of drying zones immediately on top of each other are formed by one and the same endless band (1*b*, 1*c*).

3. An apparatus according to claim 1 characterized in that each band (1*b*, 1*c*) forming two drying elements in drying zones positioned one after another is heated or cooled, respectively, in both heating zones.

4. An apparatus according to claim 1, characterized in that at least the first drying zone comprises a separate drying felt (5') and means (17) for removing water from the felt (5').

5. An apparatus according to claim 1, characterized in that it comprises a separate wire (14) for transporting the web (4), said wire being arranged to pass through each drying zone between the web (4) and the felt (5; 5', 5'').

6. An apparatus according to claim 1, characterized in that at least the first endless band (1*b*) forming two drying elements is arranged to make contact with the web (4) in both drying zones and that it is heated by the heating means (8) within both zones.

7. An arrangement for mounting rolls (2*a*–2*d*; 3*a*–3*d*) in a drying apparatus comprising at least two endless, air-tight bands (1*a*–1*d*) with good thermal conductivity, which bands are arranged to move around said rolls (2*a*–2*d* and 3*a*–3*d*) on top of each other in a direction perpendicular to the surface of a web (4) in such a manner that said bands (1*a*, 1*b*; 1*b*, 1*c*; 1*c*, 1*d*) are substantially parallel and adjacent with each other between the rolls (2*a*, 3*a*; 2*b*, 3*b*; 2*c*, 3*c*; 2*d*, 3*d*) to form at least two drying zones positioned on top of each other, the web (4) and the drying felt (5; 5', 5'') being led between two bands (1*a*, 1*a*; 1*b*, 1*c*; 1*c*, 1*d*) in such a manner that the web (4) makes contact with the surface of one band (1*b*, 1*d*) and the drying felt (5; 5', 5'') with the surface of the other band (1*a*, 1*c*), characterized in that two rolls (2*a*, 2*b*; 2*b*, 2*c*; 2*c*, 2*d*, 3*a*,3*b*, 3*c*; 3*c*, 3*d*) immediately on top of each other in a direction transverse to the surface of the web (4) are mounted in the direction of movement of the web (4) in such a manner that their axes are at a distance (L) from each other.

* * * * *